US008057179B1

(12) United States Patent
Liang

(10) Patent No.: US 8,057,179 B1
(45) Date of Patent: Nov. 15, 2011

(54) FILM COOLING HOLE FOR TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 566 days.

(21) Appl. No.: 12/252,513

(22) Filed: Oct. 16, 2008

(51) Int. Cl.
*F01D 5/08* (2006.01)

(52) U.S. Cl. ..... 416/97 R; 415/115

(58) Field of Classification Search ..... 416/96 R, 416/97 A, 97 R
See application file for complete search history.

(56) References Cited

U.S. PATENT DOCUMENTS 4,653,983 A 3/1987 Vehr
4,664,597 A * 5/1987 Auxier et al. ..... 416/97 R
4,684,323 A 8/1987 Field
5,382,133 A 1/1995 Moore et al.
6,183,199 B1 2/2001 Beeck et al.
6,287,075 B1 * 9/2001 Kercher ..... 416/97 R
6,869,268 B2 3/2005 Liang
6,918,742 B2 7/2005 Liang

* cited by examiner

*Primary Examiner* — Chandra Chaudhari
(74) *Attorney, Agent, or Firm* — John Ryznic

(57) ABSTRACT

A film cooling hole for a turbine airfoil used in a gas turbine engine, where the film cooling hole includes an expansion section with a downstream side wall having a first expansion in the middle section and a second expansion greater than the first expansion in the two corners of the downstream side wall. The corners with a greater expansion seal off hot gas ingestion between the film flow and the airfoil surface immediately downstream from the hole opening which minimize the vortices' formation and thus improve the film effectiveness level. The film cooling hole includes two side walls with an expansion of around 10 degrees and an upstream side wall with no expansion. An inlet to the diffusion section includes a metering section of constant diameter to meter cooling air flow.

12 Claims, 3 Drawing Sheets

FILM COOLING HOLE FOR TURBINE AIRFOIL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a film cooling hole for a turbine airfoil.

2. Description of the Related Art Including Information Disclosed Under 37 CFR 1.97 and 1.98

Airfoils used in a gas turbine engine, such as rotor blades and stator vanes (guide nozzles), require film cooling of the external surface where the hottest gas flow temperatures are found. The airfoil leading edge region is exposed to the highest gas flow temperature and therefore film cooling holes are used here. Film cooling holes discharge pressurized cooling, air onto the airfoil surface as a layer that forms a blanket to protect the metal surface from the hot gas flow. The prior art is full of complex film hole shapes that are designed to maximize the film coverage on the airfoil surface while minimizing loses.

Film cooling holes with large length to diameter ratio are frequently used in the leading edge region to provide both internal convection cooling and external film cooling for the airfoil. For a laser or EDM formed cooling hole, the typical length to diameter is less than 12 and the film cooling hole angle is usually no less than 20 degrees relative to the airfoil's leading edge surface. FIGS. 1 and 2 show a prior art film cooling hole with a large length to diameter (L/D) ratio as discloses in U.S. Pat. No. 6,869,268 B2 issued to Liang on Mar. 22, 2005 and entitled COMBUSTION TURBINE WITH AIRFOIL HAVING ENHANCED LEADING EDGE DIFFUSION HOLES AND RELATED METHODS. In order to attain the same film hole breakout length or film coverage shown in FIG. 2, the straight circular showerhead hole in FIG. 1 has to be at around 14 degrees relative to the airfoil leading edge surface. This also results in a length to diameter ration of near 14. Both the film cooling hole angle and L/D exceed current manufacturing capability.

FIG. 2 shows a one dimension diffusion showerhead film cooling hole design which reduces the shallow angle required by the straight hole and changes the associated L/D ratio to a more producible level. This film cooling hole includes a constant diameter section at the entrance region of the hole that provides cooling flow metering capability, and a one dimension diffusion section with less than 10 degrees expansion in the airfoil radial inboard direction. As a result of this design, a large film cooling hole breakout is achieved and the airfoil leading edge film cooling coverage and film effectiveness level is increased over the FIG. 1 straight film cooling hole.

For an airfoil main body film cooling, a two dimensional compound shaped film hole as well as a two dimensional shaped film cooling hole with curved expansion is utilized to enhance film coverage and to minimize the radial over-expansion when these cooling holes are used in conjunction with a compound angle. U.S. Pat. No. 4,653,983 issued to Vehr on Mar. 31, 1987 and entitled CROSS-FLOW FILM COOLING PASSAGE and U.S. Pat. No. 5,382,133 issued to Moore et al on Jan. 7, 1995 and entitled HIGH COVERAGE SHAPED DIFFUSER FILM HOLE FOR THIN WALLS both disclose this type of film cooling hole.

A three dimensional diffusion hole in the axial or small compound angle and variety of expansion shape was also utilized in an airfoil cooling design for further enhancement of the film cooling capability. U.S. Pat. No. 4,684,323 issued to Field on Aug. 4, 1987 and entitled FILM COOLING PASSAGES WITH CURVED CORNERS and U.S. Pat. No. 6,183,199 B1 issued to Beeck et al on Feb. 6, 2001 and entitled COOLING-AIR BORE show this type of film hole.

Another improvement over the prior art three dimensional film hole is disclosed in U.S. Pat. No. 6,918,742 B2 issued to Liang on Jul. 19, 2005 and entitled COMBUSTION TURBINE WITH AIRFOIL HAVING MULTI-SECTION DIFFUSION COOLING HOLES AND METHODS OF MAKING SAME. This multiple diffusion compounded film cooling hole starts with a constant diameter cross section at the entrance region to provide for a cooling flow metering capability. The constant diameter metering section is followed by a 3 to 5 degree expansion in the radial outward direction and a combination of a 3 to 5 degree followed by a 10 degree multiple expansions in the downstream and radial inboard direction of the film hole. There is no expansion for the film hole on the upstream side wall where the film cooling hole is in contact with the hot gas flow.

FIG. 3 shows a regular shaped film cooling hole of the prior art with the film ejection stream 11 located above the airfoil surface 12 in which vortices 13 form underneath the film cooling discharge from the hole. The film cooling hole is the standard 10-10-10 expansion file hole where the two sides and the bottom of downstream side of the hole all have 10 degrees of expansion. The film flow will penetrate into the main stream and then reattach to the airfoil surface at a distance of around 2 times the film hole diameter. Thus, hot gas injection into the space below the film injection location and subsequently a pair of vortices is formed under the film flow. As a result of the shear mixing, the film effectiveness is reduced. The film layer of cooling air reattaches to the airfoil surface downstream from the vortices that are formed.

BRIEF SUMMARY OF THE INVENTION

It is an object of the present invention to provide for a turbine airfoil with a film cooling hole that will reduce the formation of vortices between the film layer ejected and the airfoil surface.

It is another object of the present invention to provide for a film cooling hole that will improve the film cooling effectiveness of the turbine airfoil over the cited prior art references.

The film cooling hole of the present invention includes a constant diameter metering section followed by a divergent section downstream that includes multiple divergent sidewalls. The two side walls of the film hole have around 10 degrees expansion. The downstream side wall of the film hole has a middle surface with an expansion of around 7-10 degrees and an expansion of from 10-15 degrees on the two corners of this surface. There is no expansion for the film hole on the upstream sidewall where the film cooling hole is in contact with the hot gas flow. The multiple expansions occur on the downstream side wall surface only.

DETAILED DESCRIPTION OF THE INVENTION

The film cooling hole of the present invention is disclosed for use in a turbine airfoil, such as a rotor blade or a stator vane, in order to provide film cooling for the airfoil surface. However, the film cooling hole can also be used for film cooling of other turbine parts such as the combustor liner, or other parts that require film cooling for protection against a hot gas flow over the surface outside of the gas turbine engine field.

Figure 1:
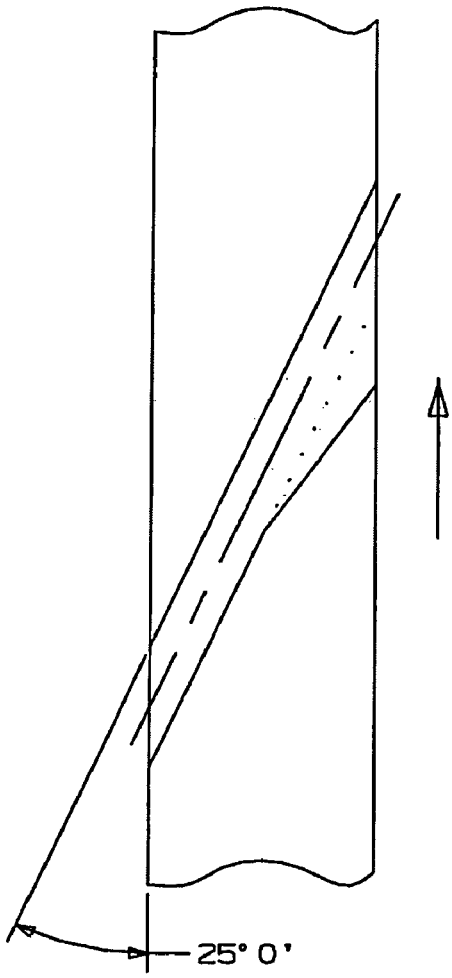
Fig 1 Prior Art
FIG. 1 shows a cross section view of a prior art film cooling hole with an expansion on the downstream side wall surface.
Figure 2:
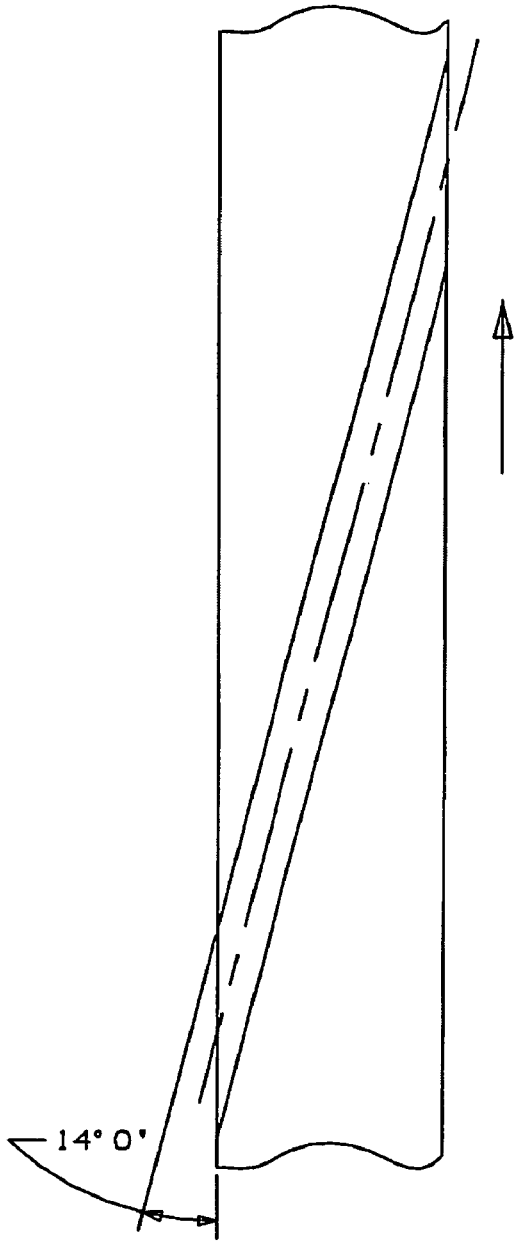
Fig 2 Prior Art
FIG. 2 shows a cross section view of a prior art film cooling hole with a straight hole passing through the wall.
Figure 3:
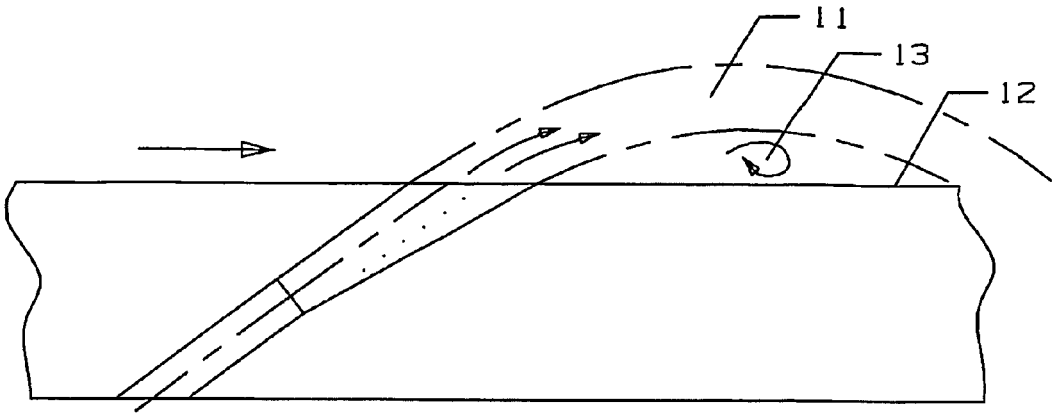
Fig 3 Prior Art
FIG. 3 shows a side view of the film cooling flow from the hole and over the airfoil surface of the prior art film cooling holes.
Figure 4:
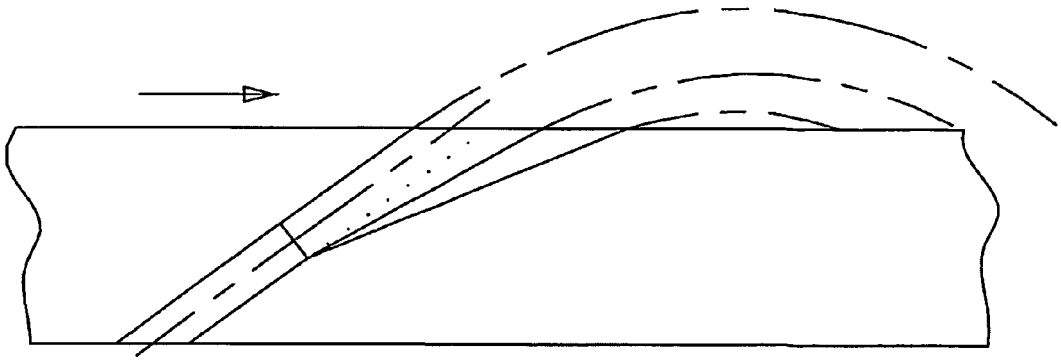
FIG. 4 shows a side view of the film cooling flow over the airfoil surface for the film cooling hole of the present invention.
Figure 5:
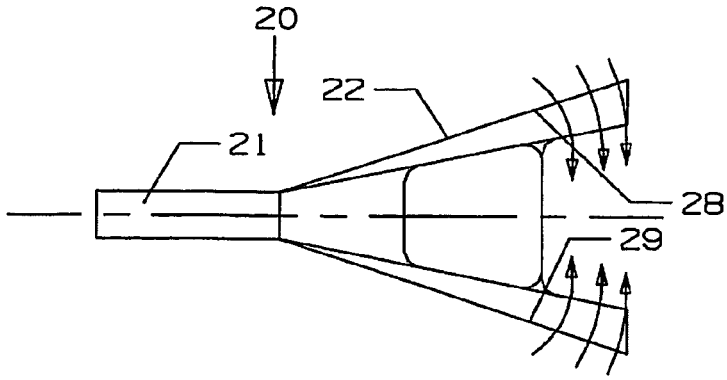
FIG. 5 shows a cross section view from the top surface of the film cooling hole of the present invention.
Figure 6:
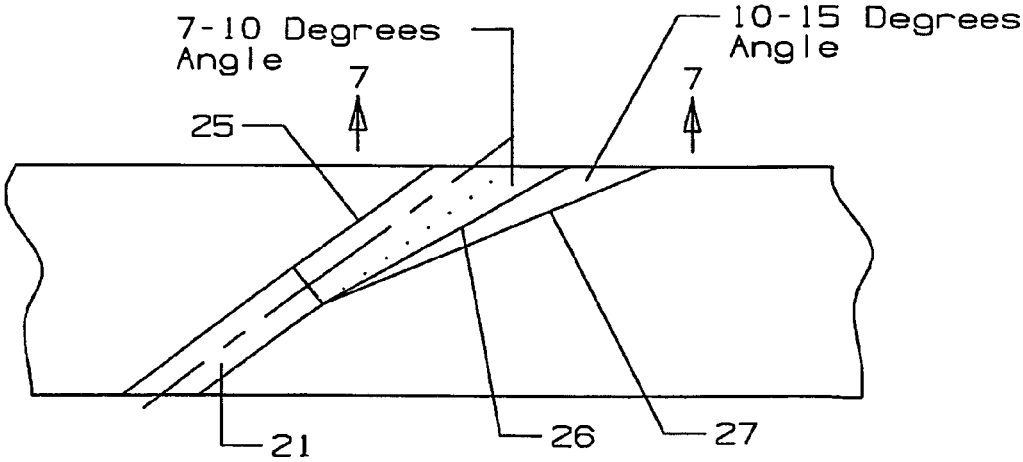
FIG. 6 shows a cross section side view of the film cooling hole of the present invention.
Figure 7:
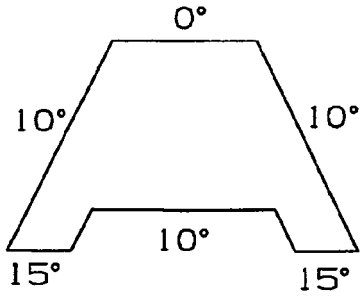
FIG. 7 shows a front view of the opening surface of the film cooling hole of the present invention.

FIGS. 5-7 show the film cooling hole of the present invention is various views. FIG. 5 shows a cross section view from the upstream side wall surface or top where the film cooling hole 20 includes a constant diameter inlet section that functions as a metering section for the film hole and a diffusion section 22 downstream that opens onto the airfoil surface. The film hole 20 includes an upstream side wall with no expansion, and two side walls 28 and 29 that both have a 10 degree expansion. The downstream side wall includes a middle surface with an expansion of 7-10 degrees and two corners that have an expansion greater than the middle section of 10-15 degrees expansion. The downstream side wall has two corners with an expansion greater than the expansion of the middle section so that the film flow occurs as seen in FIG. 4.

The film cooling hole 20 of the present invention includes a constant diameter inlet section to provide cooling flow metering, and is followed by a multiple expansion at the diffusion section downstream from the metering inlet section. The upstream side wall produces no expansion where the film cooling hole is in contact with the hot gas flow. A single diffusion is still used for both the two side walls. The multiple expansions occur on the downstream side wall surface only. For the downstream surfaces of the shaped film cooling hole, the multiple expansion surfaces is defined as 10 to 15 degrees downstream on both the corners and 7 to 10 degree expansion in the middle portion.

In the film cooling hole of the present invention, the multiple expansion at both corners for the downstream expansion surface is extended further out than the middle portion of the downstream expansion surface to force the ejected film flow to move toward the two corners. This movement toward the corners acts to minimize the formation of vortices under the film stream at the injection location. Higher film effectiveness is generated by minimizing film layer shear mixing with the hot gas flow vortices and film cooling air. An improved film layer can then be established on the airfoil surface which will yield a higher film effectiveness level over the cited prior art references.

I claim:

1. A film cooling hole for use on an airfoil surface of a gas turbine engine in which the airfoil surface is exposed to a hot gas flow, the film cooling hole comprising:

a downstream side wall surface having a middle section with a first expansion and two corners with a second expansion, where the second expansion is greater than the first expansion.

2. The film cooling hole of claim 1, and further comprising: the middle section and the two corners of the downstream side wall are all substantially flat surfaces.

3. The film cooling hole of claim 2, and further comprising: the first expansion is from around 7 to 10 degrees; and, the second expansion is from around 10 to 15 degrees.

4. The film cooling hole of claim 3, and further comprising: the film cooling hole includes two side walls both having an expansion of around 10 degrees.

5. The film cooling hole of claim 4, and further comprising: the film cooling hole includes an upstream side wall having no expansion.

6. The film cooling hole of claim 1, and further comprising: the first expansion is from around 7 to 10 degrees; and, the second expansion is from around 10 to 15 degrees.

7. The film cooling hole of claim 1, and further comprising: the film cooling hole includes two side walls both having an expansion of around 10 degrees.

8. The film cooling hole of claim 1, and further comprising: the film cooling hole includes a metering inlet section upstream from the diffusion section.

9. The film cooling hole of claim 1, and further comprising: the film cooling hole is angled in the direction of the hot gas flow over the airfoil surface from around 20 degrees to around 45 degrees.

10. A turbine airfoil for use in a gas turbine engine, the airfoil comprising:

a plurality of film cooling holes of claim 1.

11. The turbine airfoil of claim 10, and further comprising: the film cooling holes are located on the main body of the airfoil.

12. The turbine airfoil of claim 11, and further comprising: the airfoil is a rotor blade or a stator vane.

* * * * *